US006014958A

United States Patent [19]

Miwa et al.

[11] Patent Number: 6,014,958

[45] Date of Patent: Jan. 18, 2000

[54] ANTIDISSIPATION APPARATUS FOR EVAPORATED FUEL VAPOR

[75] Inventors: Makoto Miwa; Shigenori Isomura, both of Kariya; Toshihiko Muramatsu, Chiryu; Kazuji Minagawa, Tokoname; Takeshi Matsuda, Anjo; Takahiko Kato, Chiryu, all of Japan

[73] Assignee: Denso Corporation, Japan

[21] Appl. No.: 09/076,125

[22] Filed: May 12, 1998

[30] Foreign Application Priority Data

May 12, 1997 [JP] Japan ..... 9-120819
Mar. 19, 1998 [JP] Japan ..... 10-069641

[51] Int. Cl.[7] ..... F02M 37/04

[52] U.S. Cl. ..... 123/520; 123/516

[58] Field of Search ..... 123/520, 521, 123/516, 518, 519, 198 D

[56] References Cited

U.S. PATENT DOCUMENTS

| | | | |
|---|---|---|---|
| 5,377,644 | 1/1995 | Krohm | 123/520 |
| 5,390,645 | 2/1995 | Cook | 123/520 |
| 5,411,004 | 5/1995 | Busato | 123/520 |
| 5,460,141 | 10/1995 | Denz | 123/520 |
| 5,474,047 | 12/1995 | Cochard | 123/520 |
| 5,483,942 | 1/1996 | Perry | 123/520 |
| 5,499,613 | 3/1996 | Bayerle | 123/520 |
| 5,511,529 | 4/1996 | Blumenstock | 123/520 |
| 5,596,972 | 1/1997 | Sultan | 123/520 |

*Primary Examiner*—Carl S. Miller
*Attorney, Agent, or Firm*—Nixon & Vanderhye P.C.

[57] ABSTRACT

An antidissipation apparatus for evaporated fuel vapor for an internal combustion engine. A purge passage connects the intake manifold and the fuel tank. A canister is installed in the purge passage and adsorbs evaporated fuel vapor generated in the fuel tank. A purge pump is installed in the purge passage and delivers the adsorbed evaporated fuel vapor to the intake manifold. Since the purge pump is driven by at least a part of a fuel flow in the fuel passage, the purge pump can change its discharge amount of the adsorbed evaporated fuel vapor to the intake manifold according to an amount of the fuel flow in the fuel passage. Therefore, the evaporated fuel vapor which is adsorbed at the canister can be supplied (purged) to the intake manifold by the purge pump forcibly even if the engine is a lean-burn type which can not employ large negative pressure of the intake manifold.

23 Claims, 11 Drawing Sheets

ANTIDISSIPATION APPARATUS FOR EVAPORATED FUEL VAPOR

CROSS REFERENCE TO RELATED APPLICATIONS

This application is based upon and claims priority from Japanese patent application Nos. Hei 9-120819, filed May 12, 1997 and Hei 10-69641, filed Mar. 19, 1998, the entire contents of which are incorporated herein by reference.

BACKGROUND OF THE INVENTION

1. Field of the Invention

The present invention relates to an antidissipation apparatus for evaporated fuel vapor.

2. Description of Related Art

One type of known antidissipation apparatus for evaporated fuel vapor used for preventing dissipation or emission of evaporated fuel vapor produced in a fuel tank to the atmosphere has been utilized by gasoline engines. Such antidissipation apparatus for evaporated fuel vapor has a canister to adsorb evaporated fuel vapor in the fuel tank, a purge passage to connect an intake manifold to the canister, and a purge control valve which is provided at the purge passage and opened or closed according to the driving condition of the engine. When the purge control valve is opened, evaporated fuel vapor which has been adsorbed by the canister is purged into the intake manifold by a negative pressure of the intake manifold and mixed to an air to be mixed to fuel. Thus, the dissipation of evaporated fuel vapor can be prevented.

The number of automobiles with lean-burn engines which utilize leaner than theoretical or economical fuel-to-air ratios in order to improve fuel consumption, is increasing. It is known that the leaner the fuel-to-air ratio becomes, the smaller the negative pressure of the intake manifold becomes. Since the negative pressure of the intake manifold is used to purge the evaporated fuel vapor into the intake manifold, it is difficult to purge the evaporated fuel vapor into the intake manifold when the engine becomes leaner.

SUMMARY OF THE INVENTION

The present invention is made in light of the foregoing problem, and it is an object of the present invention to provide an antidissipation apparatus for evaporated fuel vapor which can prevent dissipation or emission of evaporated fuel vapor without sufficient negative pressure of the intake manifold.

It is another object of the present invention to provide an antidissipation apparatus for evaporated fuel vapor which can detect a failure of the antidissipation apparatus.

According to the antidissipation apparatus for evaporated fuel vapor of the present invention, the antidissipation apparatus for evaporated fuel vapor for an internal combustion engine having an intake manifold, a fuel passage and a fuel tank includes a purge passage for connecting the intake manifold and the fuel tank, a canister which is installed in the purge passage for adsorbing evaporated fuel vapor which is generated in the fuel tank, and a purge pump which is installed in the purge passage for delivering the adsorbed evaporated fuel vapor to the intake manifold. Since the purge pump is driven by at least a part of a fuel flow in the fuel passage, the purge pump can change its discharge amount of the adsorbed evaporated fuel vapor to the intake manifold according to an amount of the fuel flow in the fuel passage. Therefore, the evaporated fuel vapor which is adsorbed at the canister can be supplied (purged) to the intake manifold by the purge pump forcibly even if the engine is a lean-burn type which can not employ large negative pressure of the intake manifold.

According to another aspect of the present invention, the antidissipation apparatus includes an internal pressure detector which detects an internal pressure of the purge passage and a failure diagnosis process for determining a failure of the purge pump under condition that the internal pressure of the purge passage which is detected by the internal pressure detector is higher than a predetermined pressure when the purge pump is in operation and the canister control valve is closed. Therefore, the antidissipation apparatus for evaporated fuel vapor can detect the failure of the antidissipation apparatus.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

Embodiments of the present invention will be described hereinafter with reference to the drawings.

(First Embodiment)

A first embodiment of the present invention is shown in FIGS. 1 through 6.

Figure 1:
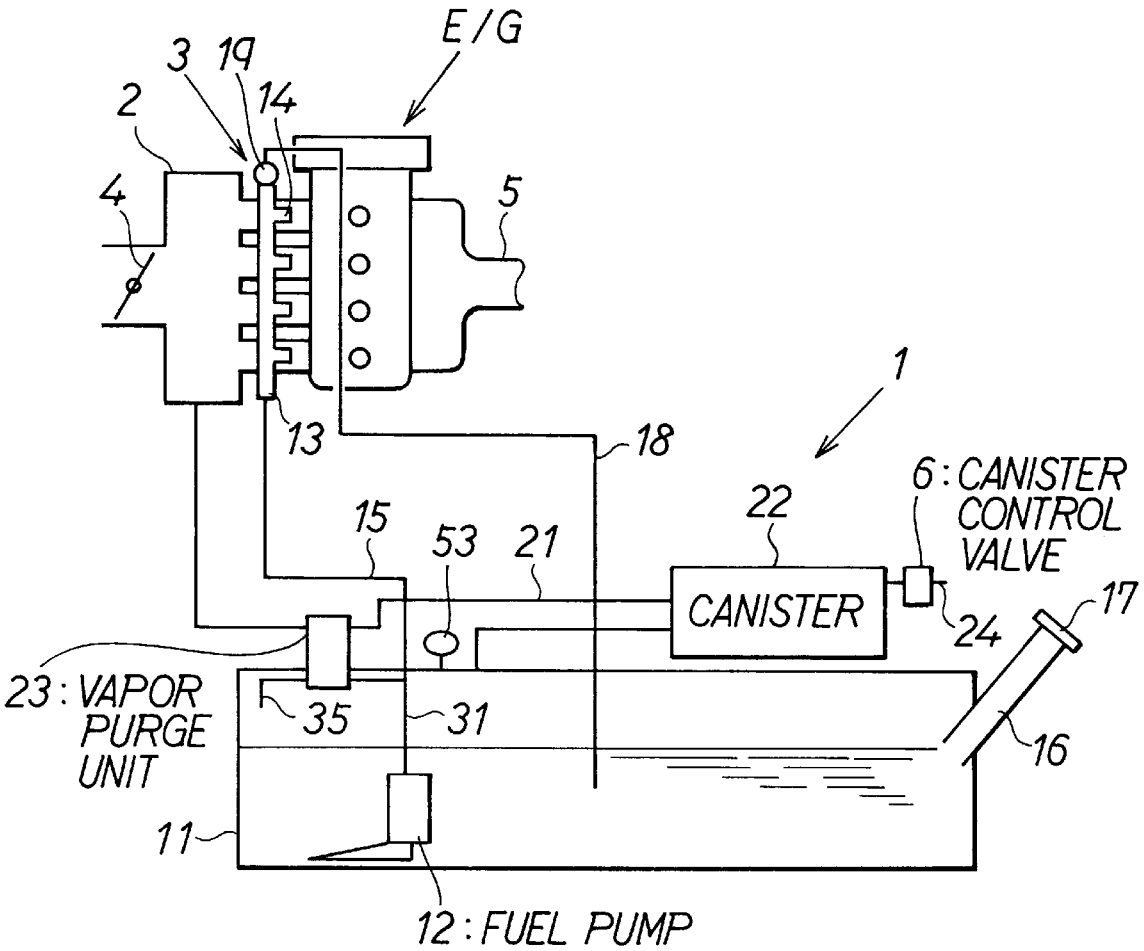
FIG. 1 is a schematic illustration of a fuel piping system according to a first embodiment of the present invention.

As shown in FIG. 1, an antidissipation apparatus for evaporated fuel vapor 1 is located parallel to a fuel injection apparatus 3 which injects liquid fuel such as gasoline into an intake manifold 2 of a gasoline engine(E/G) for an automobile. A throttle valve 4 which can be actuated cooperatively with an accelerator pedal (not shown) is located in the intake manifold 2. The intake manifold 2 is connected to a combustion chamber (not shown) which is formed between a cylinder and a piston. The combustion chamber is connected to an exhaust pipe 5 for exhausting exhaust gas.

The fuel injection apparatus 3 has a fuel tank 11 to store gasoline, a fuel pump 12 to pump and pressurize gasoline in the fuel tank 11, a fuel manifold 13 which is provided at the intake manifold 2, plural fuel injectors 14 which are located inside the fuel manifold 13, and a main fuel passage 15 which connects the fuel pump 12 and the fuel manifold 13. The fuel pump 12 and each one of the fuel injectors 14 are electronically controlled by an engine control unit (E/G ECU) 40.

The fuel tank 11 is located between a passenger compartment and a trunk. The fuel tank 11 has a filler neck 16 and a filler cap 17. A purge hole (not shown) is formed at a ceiling portion of the fuel tank 11 to let the antidissipation apparatus for evaporated fuel vapor 1 adsorb evaporated fuel vapor.

The fuel pump 12 pumps gasoline up from the fuel tank 11 and deliver pressurized gasoline to the fuel manifold 13. The fuel manifold 13 distributes such pressurized gasoline to each one of the fuel injectors 14. Pressure of gasoline in the fuel manifold 13 is kept constant by a pressure control valve 19. Extra gasoline after such gasoline pressure control returns to the fuel tank 11 through a return pipe 18. The fuel injectors 14 inject atomized gasoline to each inlet port of the intake manifold 2 based on injection signals from the engine ECU 40.

As shown in FIG. 1, an antidissipation apparatus for evaporated fuel vapor 1 has a canister 22 which is provided at a purge passage 21, and a vapor purge unit 23 which is provided at the purge passage 21 between the intake manifold 2 and the canister 22. Gasoline vapor produced in the fuel tank 11 is purged into the intake manifold 2 through the canister 22 and the vapor purge unit 23. Therefore, the dissipation or emission of gasoline vapor to the atmosphere can be prevented.

The purge passage 21 connects the intake manifold 2 which locates between the downstream of the throttle valve 4 and each inlet port to the purge hole of the fuel tank 11 as a evaporated fuel vapor passage. The canister 22 has activated charcoal to adsorb evaporated fuel vapor. Therefore, the canister can adsorb evaporated fuel vapor which is produced in the fuel tank 11 through the purge hole and the purge passage 21. The canister 22 also has an atmospheric hole 24 for an air intake from the atmosphere and a canister control valve 6 which closes or opens the atmospheric hole 24 as an exciting close type electromagnetic valve.

Figure 2:
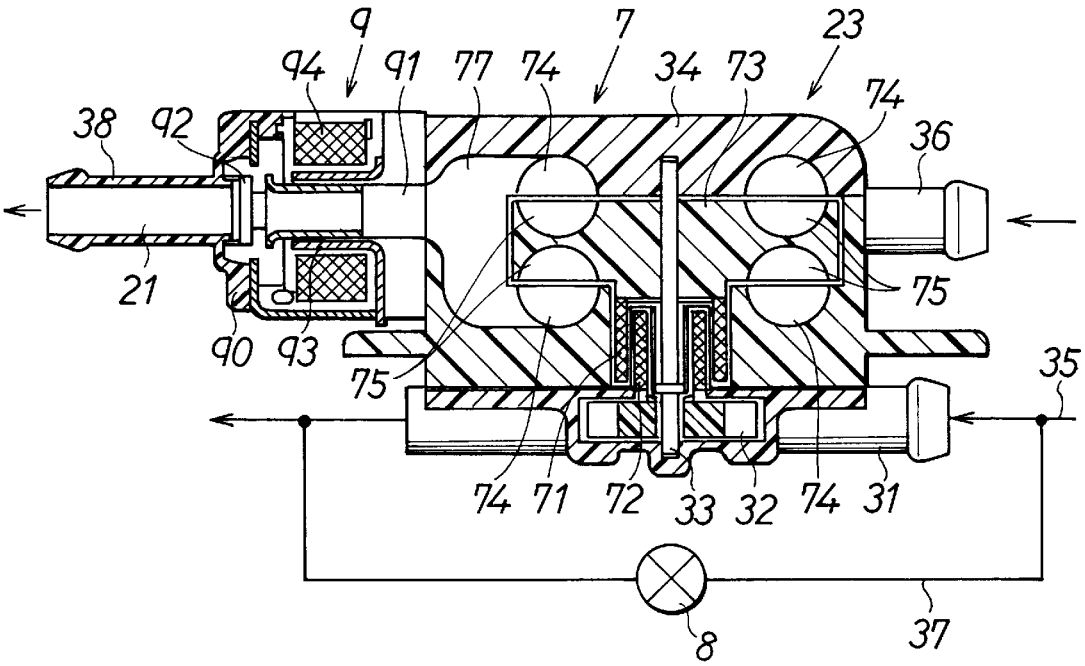
FIG. 2 is a sectional view of a vapor purge unit according to the first embodiment of the present invention.
Figure 5:
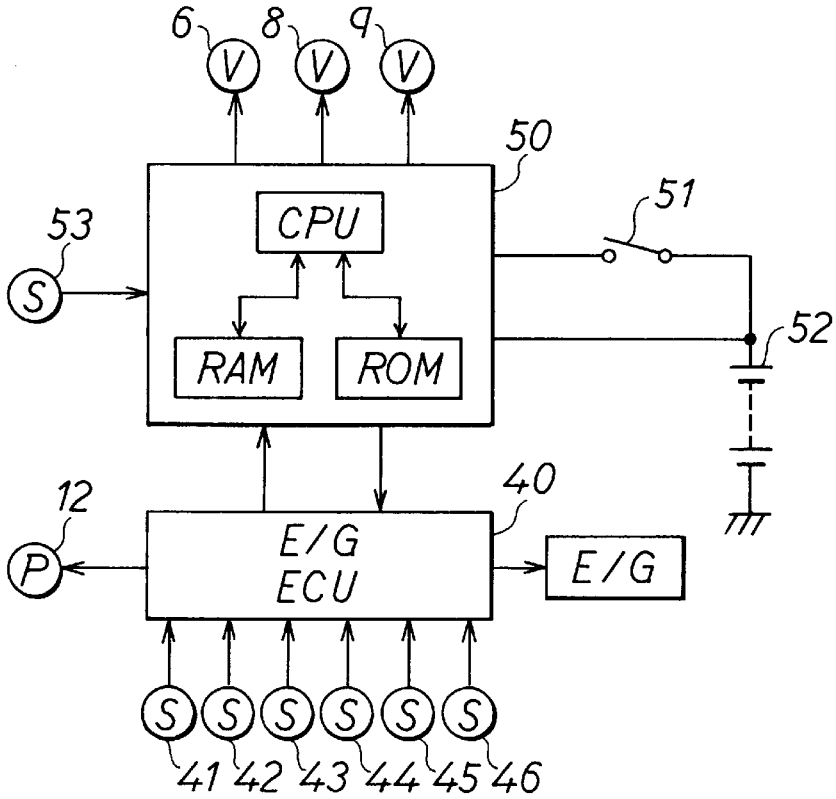
FIG. 5 is a schematic block diagram which represents a control system of an antidissipation apparatus for evaporated fuel vapor and a fuel injection apparatus according to the first embodiment of the present invention.

The vapor purge unit 23 has a purge pump 7, bypass valve 8 and a purge control valve 9 as shown in FIG. 2. The purge pump 7, which is driven by the fuel flow, pressurizes and delivers evaporated fuel vapor inside the canister 22 to the intake manifold 2. The bypass valve 8 controls a flow rate of fuel which drives the purge pump 7. The purge control valve 9 controls purge flow rate of evaporated fuel vapor. As shown in FIG. 5, the canister control valve 6, the bypass valve 8 and the purge control valve 9 are controlled by a purge flow control unit (purge ECU) 50 which is connected to the E/G ECU 40 via communication circuit.

Figure 3:
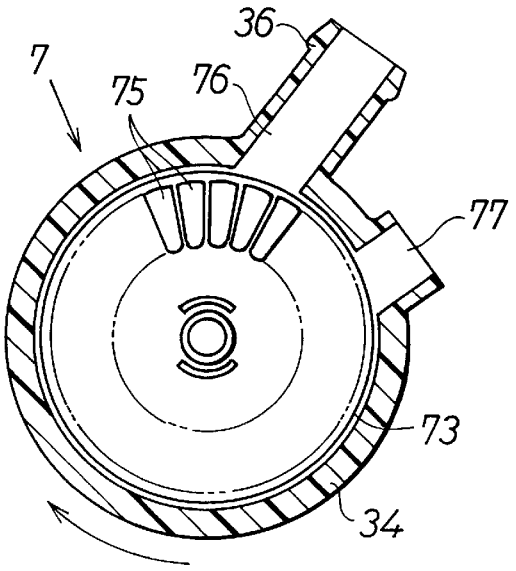
FIG. 3 is a partially sectional view of a purge pump according to the first embodiment of the present invention.

As shown in FIGS. 2 and 3, the purge pump 7, which is preferably a so called 'side channel pump', has a Pelton wheel 32, a pump housing 34 and a turbine 73. The Pelton wheel 32 is located in a fuel pipe 31 and changes its rotational speed according to the flow rate of liquid fuel. The turbine 73 is connected to a rotation shaft 33 through magnet couplings 71 and 72. The turbine 73 has hollows 75 at its outer edges corresponding to hollows 74 of an inner surface of the pump housing 34.

The fuel pipe 31 is connected to a sub-fuel passage 35 which forks from the main fuel passage 15 at an upstream of the purge pump 7 and is connected to the fuel tank 11 via the purge pump 7. An inlet pipe 36 which is formed with the pump housing 34 is connected to an outlet of the canister 22 via the purge passage 21. The pump housing 34 has an inlet port 76 and an outlet port 77.

A bypass passage 37 bypasses liquid fuel in the sub-fuel passage 35 from the fuel pipe 31 and the Pelton wheel 32. The bypass passage 37 has the bypass valve 8 which changes the opening cross sectional area of the bypass passage 37 according to the supplied amount of current as an electromagnetic controlled valve. When the bypass valve 8 reduces the opening cross sectional area of the bypass passage 37, the amount of the flow of the liquid fuel in the fuel pipe 31 increases proportionally. Therefore, discharge amount of evaporated fuel vapor from the purge pump 7 increases. On the other hand, when the bypass valve 8 increases the opening cross sectional area of the bypass passage 37, the amount of the flow of the liquid fuel in the fuel pipe 31 decreases proportionally. Therefore, discharge amount of evaporated fuel vapor from the purge pump 7 decreases.

Thus, discharge amount of evaporated fuel vapor from the purge pump 7 is controlled by the supplied amount of current to the bypass valve 8 which is controlled by the purge ECU 50. For example, when the supply of current to the bypass valve 8 is stopped (OFF), the bypass valve 8 is closed and the discharge amount of evaporated fuel vapor from the purge pump 7 is maximized, such as 40 liters/min.–60 liters/min. When current is supplied to the bypass valve 8 (ON), the bypass valve 8 is opened and the discharge amount of evaporated fuel vapor from the purge pump 7 is minimized, such as 0 liter/min.–10 liters/min.

The purge control valve 9 has a housing 90, a connection passage 91, valve 92, core plate 93 and an electromagnetic coil 94. The housing 90 is formed at the bottom of the outlet pipe 38 of the pump housing 34 by integral molding. The purge passage 21 is formed inside of the outlet pipe 38 and the housing 90. The valve 92 closes or opens the connection passage 91 which is formed between the purge passage 21 and the outlet port 77 of the purge pump 7. The core plate 93 actuates the valve 92 by sucking when it is magnetized by an electromagnetic coil 94.

Figure 4:
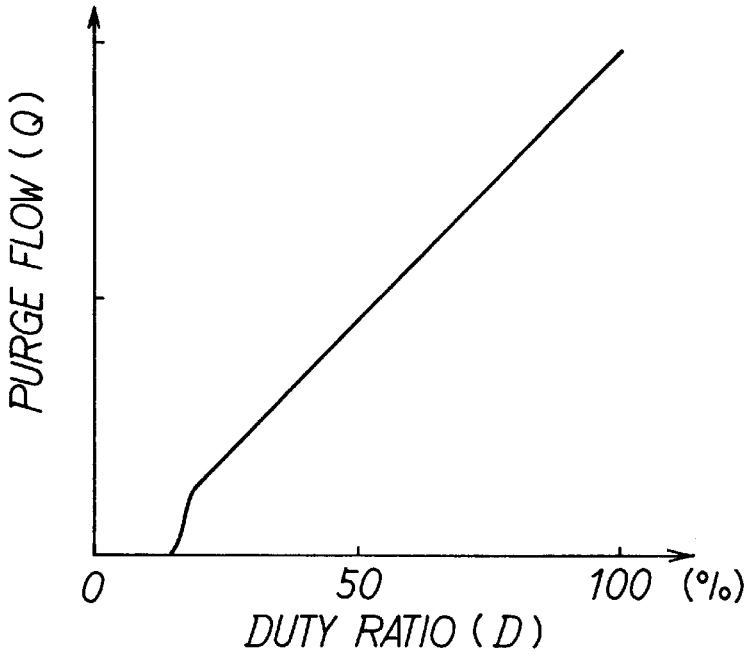
FIG. 4 is a graph which represents a relationship between duty ratio(D) of a purge control valve and purge flow(Q) according to the first embodiment of the present invention.

As shown in FIG. 4, the purge control valve 9 is a flow control valve which controls the purge flow of evaporated fuel vapor to be supplied to the intake manifold 2 according to the duty ratio of valve opening (ON) time and valve closing (OFF) time. The purge control valve 9 is also an exciting open type electromagnetic valve which closes the valve 92 when current is supplied to the electromagnetic coil 94. When the valve 92 of the purge control valve 9 is closed, the supply of evaporated fuel vapor to the intake manifold 2 is stopped.

Operations of the E/G ECU 40 and the purge ECU 50 are described below along with FIGS. 1 and 5.

The E/G ECU 40 is a microcomputer which includes CPU, ROM, RAM and timer circuit to control the engine. The E/G ECU 40 receives signals which represent driving conditions of the engine from an engine rotational speed sensor 41, speed sensor 42, throttle sensor 43, cooling water temperature sensor 44, intake amount sensor 45 and oxygen sensor 46, and a signal from the purge ECU 50.

The E/G ECU 40 performs idling speed control, fuel injection quantity control, fuel injection timing control, intake amount control, air-fuel ratio feedback control and ignition timing control and outputs signals necessary for calculation at the purge ECU 50 based on the received signals from the sensors 41, 42, 43, 44, 45 and 46 and the purge ECU 50 and preinputted program in the ROM.

The engine rotational speed sensor 41 detects rotational speed of a crankshaft of the engine. The speed sensor 42 detects speed of an automobile, such as a lead switch type speed sensor, a photoelectric type speed sensor or a magnetic resistance element (MRE) type speed sensor. The throttle sensor 43 detects a valve travel of the throttle valve 4.

The cooling water temperature sensor 44 detects the temperature of the cooling water which cools the engine. The intake amount sensor 45 has an airflow meter and detects intake air mass flow which is sucked to the intake manifold 2 via an air filter. The oxygen sensor 46 detects oxygen content of the exhaust gas in the exhaust pipe 5 for the air-fuel ratio feedback control.

The purge ECU 50 is a microcomputer which includes CPU, ROM, RAM and timer circuit to control the purge flow and/or for fail detection.

Current is supplied to the purge ECU 50 from a battery 52 when an ignition switch 51 is turned on, and the purge ECU 50 controls the purge pump 7, the bypass valve 8 and the purge control valve 9 of the vapor purge unit 23 and the canister control valve 6 based on signals from an internal pressure sensor 53 and the E/G ECU 40 and the preinputted program in the ROM.

The internal pressure sensor 53 is located at the upper portion of the fuel tank 11 and detects the internal pressure of the fuel tank 11 and the fuel piping system of the antidissipation apparatus for evaporated fuel vapor 1. The internal pressure sensor 53 may be located at the purge passage 21 or the canister 22 to detect the internal pressure.

Figure 6:
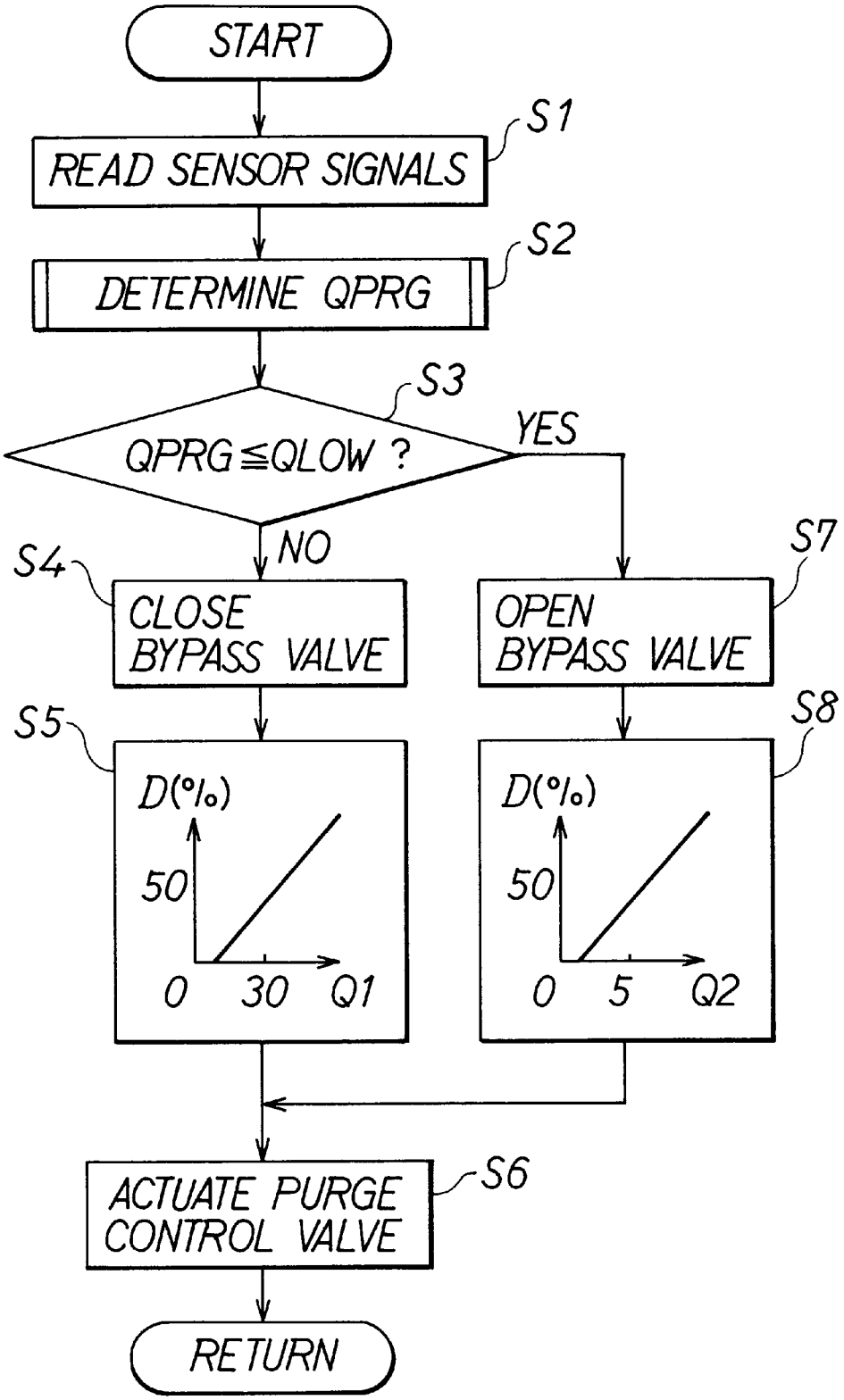
FIG. 6 is a flow chart which represents a purge flow control of a purge ECU according to the first embodiment of the present invention.

The purge flow control of the first embodiment of the present invention is described below based on FIG. 6. The flow chart shown in FIG. 6 is performed at certain intervals, such as every 10 microseconds or 100 microseconds.

At step S1, sensor signals which are required of the purge flow control are read from the E/G ECU 40, such as sensor signals from the throttle sensor 43 or the intake amount sensor 45.

At step S2, required purge flow (QPRG) of evaporated fuel vapor to be supplied to the intake manifold 2 is determined according to a characteristic diagram (not shown) or an equation based on the driving condition (for example, intake amount which is detected by the intake amount sensor 45) of the engine. The required purge flow (QPRG) of evaporated fuel vapor may be calculated according to the throttle valve travel detected by the throttle sensor 43.

At step S3, the QPRG is compared with predetermined purge flow (QLOW) which is 10 liters/minute and it is determined whether the QPRG is not greater than the QLOW. The QLOW may be predetermined between 5 and 10 liters/minute. When the QPRG is greater than the QLOW, the bypass valve 8 is closed at step S4 and drive the purge pump 7 actively by increasing liquid fuel which drives the Pelton wheel 32. Under this circumstance, discharge amount of the purge pump 7 is normal(for example, between 40 and 60 liters/minute).

At step S5, the duty ratio(D) of the purge control valve 9 is determined within the range between the maximum discharge amount(for example, 60 liters/minute) and the minimum discharge amount(for example, 0 liter/minute) according to the memorized characteristic in the ROM which is shown in characteristic diagram in step S5. The duty ratio (D) is calculated according to the following equation.

$$D(\%)=[\text{Time of ON}/(\text{Time of ON}+\text{Time of OFF})]\times 100(\%)$$

At step S5, the duty ratio(D) of the purge control valve 9 is determined as 17% when the QPRG(Q1) is 10 liters/minute. The duty ratio(D) of the purge control valve 9 is determined as 50% when the QPRG(Q1) is 30 liters/minute. The duty ratio(D) of the purge control valve 9 is determined as 83% when the QPRG(Q1) is 50 liters/minute. The duty ratio(D) of the purge control valve 9 is determined as 100% when the QPRG(Q1) is 60 liters/minute.

At step S6, the purge control valve 9 is actuated according to the duty ratio(D) which is determined at step S5.

When the QPRG is not greater than the QLOW at step S3, the bypass valve 8 is opened at step S7 and the purge pump 7 is driven inactively by decreasing liquid fuel which drives the Pelton wheel 32. Under this circumstance, discharge amount of the purge pump 7 is lower than normal(for example, between 0 and 10 liters/minute).

At step S8, the duty ratio(D) of the purge control valve 9 is determined within the low range between the QLOW(for example, 10 liters/minute) and the minimum discharge amount(for example, 0 liter/minute) according to the memorized characteristic in the ROM which is shown in characteristic diagram in step S8.

At step S8, the duty ratio(D) of the purge control valve 9 is determined as 20% when the QPRG(Q2) is 2 liters/minute. The duty ratio(D) of the purge control valve 9 is determined as 50% when the QPRG(Q2) is 5 liters/minute. The duty ratio(D) of the purge control valve 9 is determined as 70% when the QPRG(Q2) is 7 liters/minute. The duty ratio(D) of the purge control valve 9 is determined as 100% when the QPRG(Q2) is 10 liters/minute.

At step S6, the purge control valve 9 is actuated according to the duty ratio(D) which is determined at step S8.

Operations of the antidissipation apparatus for evaporated fuel vapor 1 are described below according to FIGS. 1 through 6.

Liquid fuel in the fuel tank 11 evaporates when the surrounding temperature of the fuel tank 11 becomes high. Such evaporated fuel vapor is adsorbed in adsorbent which is located in the canister 22 through the purge hole and the purge passage 21. The required purge flow (QPRG) of evaporated fuel vapor to be supplied to the intake manifold 2 is determined according to the driving condition (for example, intake amount or throttle valve travel) of the engine. The bypass valve 8 is opened or closed according to the result of the comparison of the QPRG and the QLOW. During these operations, the atmospheric hole 24 of the canister 22 is opened by the canister control valve 6.

When the bypass valve 8 is closed, a part of liquid fuel which is pressurized and delivered to the fuel injector 14 from the fuel tank 11 by the fuel pump 12 flows into the fuel pipe 31. Thus, the Pelton wheel 32 rotates actively with high speed and the rotation shaft 33 of the purge pump 7 rotates with highspeed. Therefore,the purge pump 7 is driven in such a manner that the discharge amount becomes normal (for example, between 10 and 60 liters/minute).

The duty ratio(D) of the purge control valve 9 is determined at step S5 in FIG. 6 when the bypass valve 8 is closed. The purge flow of evaporated fuel vapor corresponding to the QPRG is supplied to the intake manifold 2 from the canister 22 through the purge pump 7 and the purge control valve 9 after desorption from the adsorbent caused by air sucked from the atmospheric hole 24. Therefore, dissipation or emission of evaporated fuel vapor can be prevented. Since the discharge amount of the purge pump 7 is as large as 40–60 liters/minute, the differential pressure ΔP between the upstream and the downstream of the purge control valve 9 becomes greater in proportion to the restriction of the purge flow by the purge control valve 9.

When the bypass valve 8 is opened (opening area may be changed.), very little part of liquid fuel which is pressurized and delivered to the fuel injector 14 from the fuel tank 11 by the fuel pump 12 flows into the fuel pipe 31. Thus, the Pelton wheel 32 rotates inactively with low speed and the rotation shaft 33 of the purge pump 7 rotates with low speed. Therefore, the purge pump 7 is driven in such a manner that the discharge amount becomes low(for example, between 0 and 10 liters/minute).

The duty ratio(D) of the purge control valve 9 is determined at step S8 in FIG. 6 when the bypass valve 8 is closed. The purge flow of evaporated fuel vapor corresponding to the QPRG is supplied to the intake manifold 2 from the canister 22 through the purge pump 7 and the purge control valve 9 after desorption from the adsorbent caused by air sucked from the atmospheric hole 24. Therefore, dissipation or emission of evaporated fuel vapor can be prevented. Since the discharge amount is as small as 0–10 liters/minute, the differential pressure ΔP between the upstream and the downstream of the purge control valve 9 becomes small even if the purge flow is restricted by the purge control valve 9.

The failure diagnosis of the antidissipation apparatus for evaporated fuel vapor 1 of the first embodiment of the present invention is as follows.

The failure diagnosis of the antidissipation apparatus for evaporated fuel vapor 1 is carried out when the throttle valve travel and car speed are greater than certain values or when the engine rotational speed and the throttle valve travel are not greater than certain values. The failure diagnosis of the antidissipation apparatus for evaporated fuel vapor 1 may be carried out when the engine starts or every certain period (for example, every 1 to 24 hours).

The purge pump 7 is driven by opening or closing the bypass valve 8 according to the QPRG under above circumstances which require to purge. Then, the purge control valve 9 is opened and the atmospheric hole 24 is closed by the canister control valve 6. Certain time (for example, 5 to 10 seconds) after closing the purge control valve 9, the internal pressure of the fuel tank 11 (PT) is detected by the internal pressure sensor 53.

When the internal pressure of the fuel tank 11 (PT) which is detected by the internal pressure sensor 53 is higher than the predetermined internal pressure (PTRET) which is, for example, 10 mmHg lower than the atmospheric pressure, the antidissipation apparatus for evaporated fuel vapor 1 is considered as a failure and inform a driver of the failure by means of sound warning such as a buzzer and/or sight warning such as a lump. A crack of the fuel tank 11, a crack, a bend or crushing of a rubber hose which forms the purge passage 21, a disconnection of the rubber hose and failures of the purge pump 7 or purge control valve 9 may be possible as a cause of the failure.

According to the first embodiment of the present invention, evaporated fuel vapor which is adsorbed at the canister 22 can be supplied (purged) to the intake manifold 2 forcibly even if the engine is a lean-burn type which can not employ large negative pressure of the intake manifold because the antidissipation apparatus for evaporated fuel vapor 1 has the purge pump 7 and the purge control valve 9 at the purge passage 21 which connects the fuel tank 11 to the intake manifold 2. Therefore, dissipation or emission of evaporated fuel vapor can be prevented without sufficient negative pressure of the intake manifold and can be prevented against any type of engines.

If the duty ratio(D) of the purge control valve 9 is changed between 0 and 100% without changing the discharge amount of the purge pump 7 (for example, 40 to 60 liters/minute) after providing the purge control valve 9 at the downstream of the purge pump 7, the differential pressure ΔP between the upstream and the downstream of the purge control valve 9 becomes greater in proportion to the restriction of the purge flow (in other words, when the duty ratio(D) of the purge control valve 9 is lower than 15 to 20%). Therefore, the linearity of the relationship between the duty ratio(D) of the purge control valve and the purge flow (Q) can not be achieved as shown in FIG. 4.

According to the first embodiment of the present invention, the use of the non-linear portion can be reduced because the discharge amount of the purge pump 7 is reduced by opening the bypass valve 8 when the QPRG is not greater than the QLOW and the duty ratio(D) of the purge control valve 9 is determined under the small amount of absolute purge flow. Therefore, the linearity of the relationship between the duty ratio(D) of the purge control valve 9 and the purge flow (Q) can be achieved even if the purge flow to be supplied to the intake manifold 2 is small.

According to the first embodiment of the present invention, the purge flow can be controlled roughly between the maximum discharge amount and the minimum discharge amount with a certain unit, such as 0.6 liters/minute when the QPRG is greater than the QLOW. Furthermore, the purge flow can be controlled precisely between the QLOW and the minimum discharge amount with smaller unit, such as 0.1 liters/minute when the QPRG is greater than the QLOW.

According to the first embodiment of the present invention, an expensive drive circuit or an electronic actuator such as a motor only for driving the purge pump 7 because the purge pump 7 is driven by and its discharge amount is controlled in proportion to the flow rate of fuel in the sub-fuel passage 35 which forks from the main fuel passage 15. Therefore, the cost of the antidissipation apparatus for evaporated fuel vapor 1 can be reduced.

(Second Embodiment)

Figure 7:
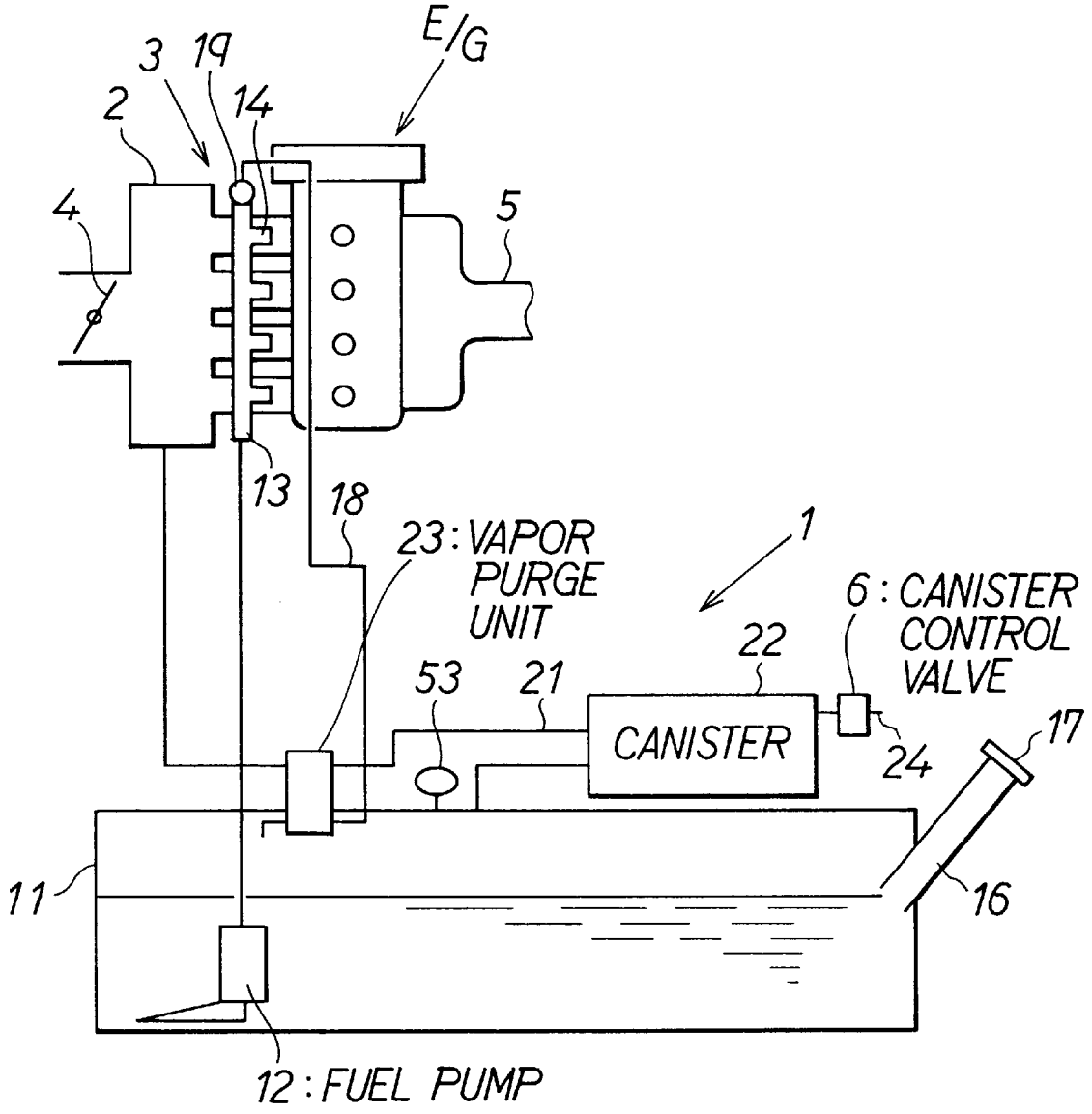
FIG. 7 is a schematic illustration of a fuel piping system according to a second embodiment of the present invention.
Figure 8:
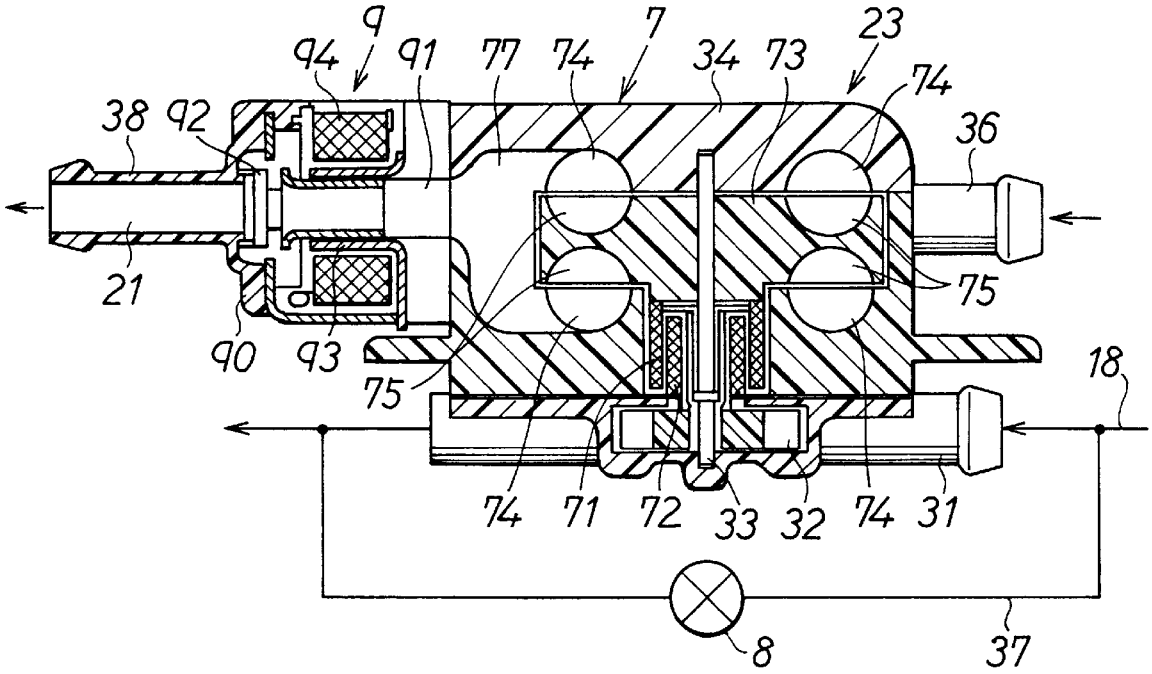
FIG. 8 is a sectional view of a vapor purge unit according to the second embodiment of the present invention.

A second embodiment of the present invention is shown in FIGS. 7 and 8. In this and the following embodiments, components which are substantially the same to those in previous embodiments are assigned the same reference numerals.

The difference between the first embodiment and the second embodiment is the structure of the power source to drive the purge pump 7. In the second embodiment, the return pipe 18 is connected to the fuel pipe 31 of the purge pump 7 to drive the purge pump 7. Since extra liquid fuel which is not necessary for fuel injections at the fuel injectors 14 always returns to the fuel tank 11 through the return pipe 18, the purge pump 7 can be driven.

(Third Embodiment)

Figure 9:
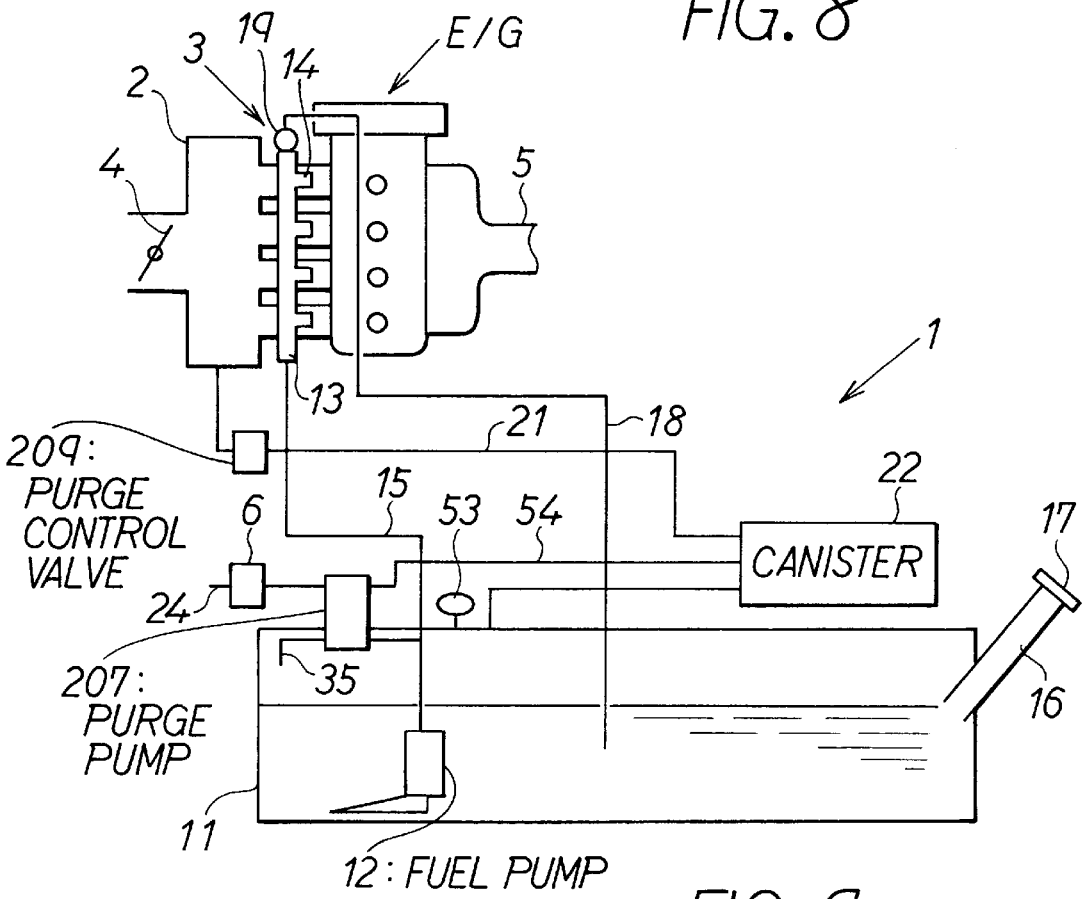
FIG. 9 is a schematic illustration of a fuel piping system according to a third embodiment of the present invention.
Figure 10A:
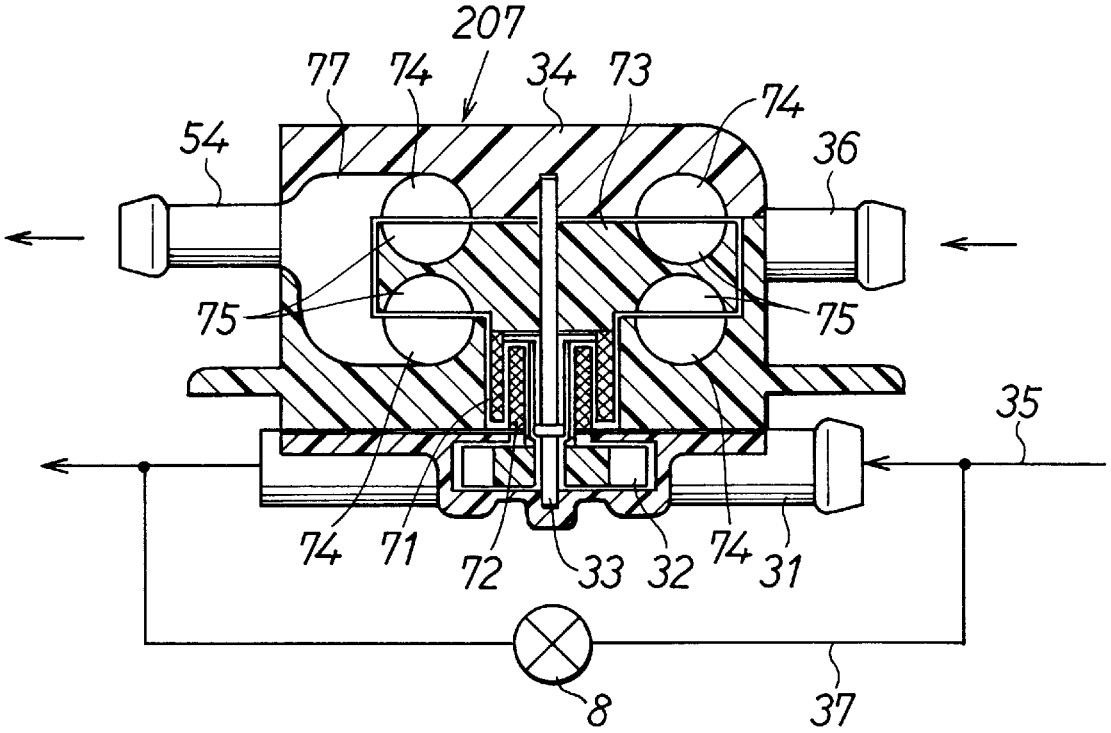
FIG. 10A is a partially sectional view of a purge pump according to the third embodiment of the present invention.
Figure 10B:
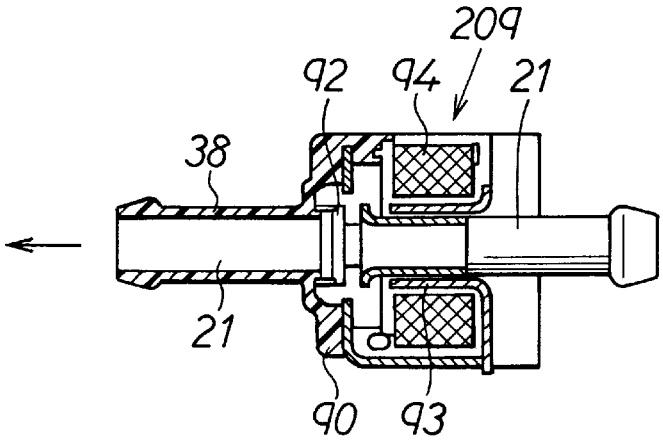
FIG. 10B is a partially sectional view of a purge control valve according to the third embodiment of the present invention.
Figure 11:
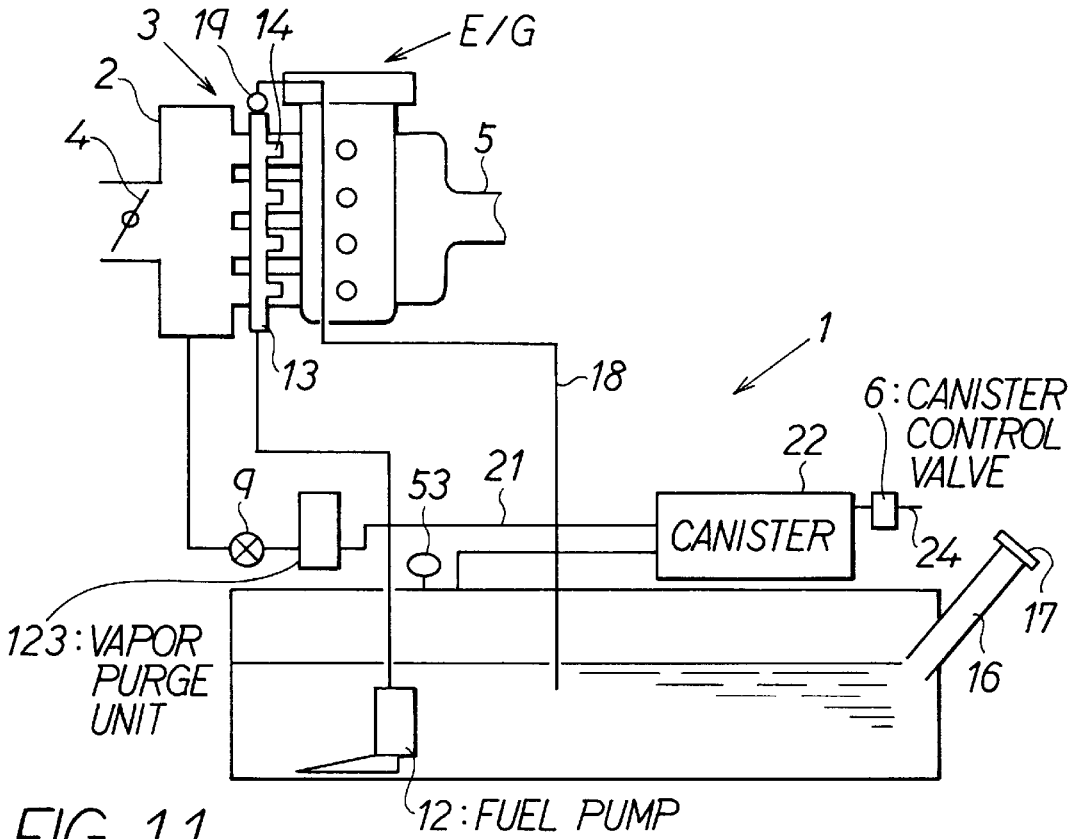
FIG. 11 is a schematic illustration of a fuel piping system according to a fourth embodiment of the present invention.
Figure 13:
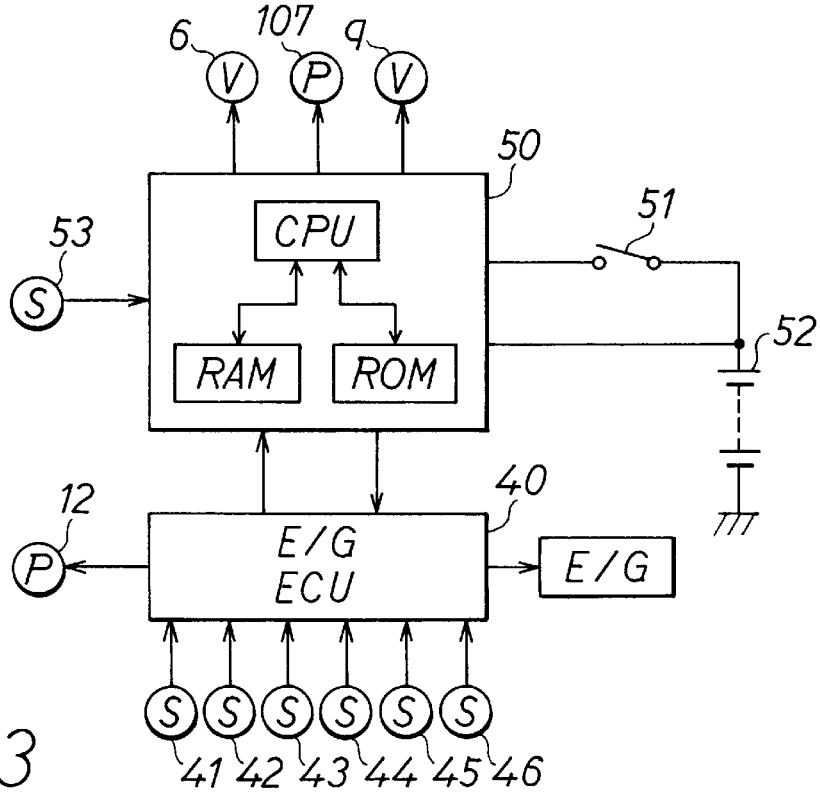
FIG. 13 is a schematic block diagram which represents a control system of an antidissipation apparatus for evaporated fuel vapor and a fuel injection apparatus according to the fourth embodiment of the present invention.
Figure 12A:
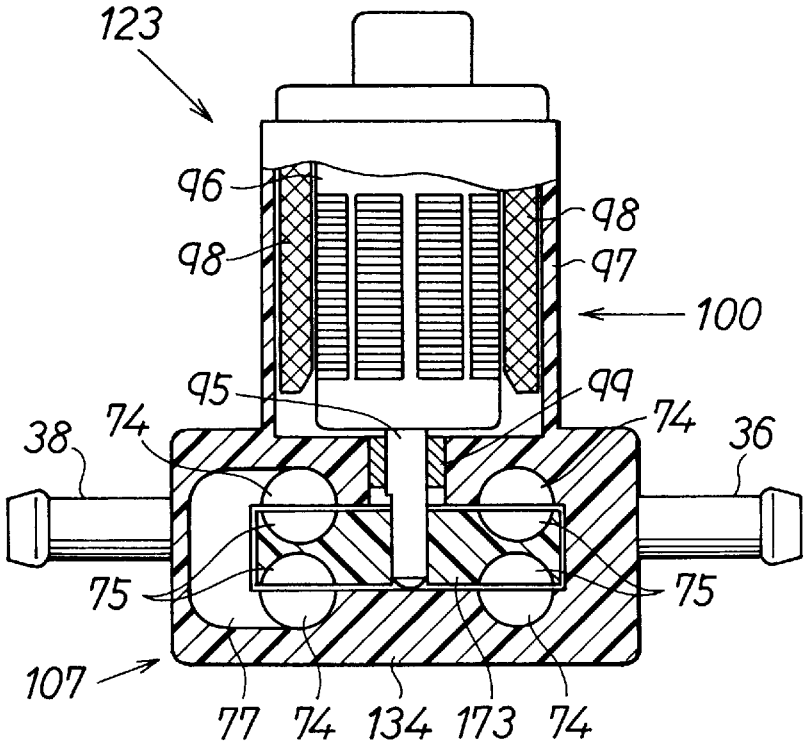
FIG. 12A is a sectional view of a vapor purge unit according to the fourth embodiment of the present invention.
Figure 12B:
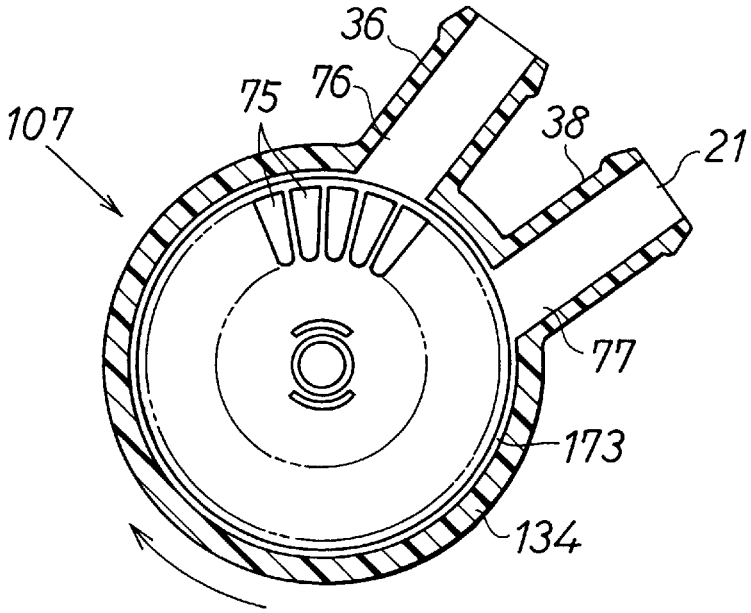
FIG. 12B is a partially sectional view of a purge pump according to the fourth embodiment of the present invention.

A third embodiment of the present invention is shown in FIGS. 9 and 10.

When the vapor purge unit 23 including the purge pump 7 is located on the purge passage 21 between the canister 22 and the intake manifold 2 as described in the first and the second embodiments, it is desirable to locate the canister 22 near the fuel tank 11 to avoid pressure loss caused in proportion to the length of the fuel pipes. Therefore, there is little flexibility of the mounting space for the canister 22.

In the third embodiment of the present invention, an atmospheric passage 54 is connected to the canister 22. The atmospheric hole 24 and the canister control valve 6 are provided at the end of the atmospheric passage 54 for the air intake from the atmosphere. The canister control valve 6 opens or closes the atmospheric hole 24. A purge pump 207 is provided on the atmospheric passage 54 between the canister 22 and the canister control valve 6. A purge control valve 209 is provided on the purge passage 21 between the canister 22 and the intake manifold 2.

According to the third embodiment of the present invention, the total length of the fuel pipes is not changed so much between the cases when the canister 22 is located near the fuel tank 11 and when the canister 22 is located near the intake manifold 2. Therefore, the flexibility of the mounting space for the canister 22 is increased.

(Fourth Embodiment)

A fourth embodiment of the present invention is shown in FIGS. 11, 12A, 12B, 13 and 14.

In the fourth embodiment of the present invention, a vapor purge unit 123 which includes a purge pump 107 whose discharge amount of the evaporated fuel vapor can be changed by a motor 100 is located on the purge passage 21 between the intake manifold 2 and the canister 22.

The purge pump 107 has a housing 134, a turbine 173 and the motor 100. The motor 100 has an armature 96, a yoke 97 and plural permanent magnets 98. The armature 96 has an output shaft 95 which is fixed to the turbine 173. The pipe-shaped yoke 97 is formed together with the housing 134 by integral molding. The magnets 98 are located in the yoke 97 and are facing an outer surface of the armature 96. A bearing 99 is located between the housing 134 and the output shaft 95. The purge control valve 9 is located on the purge passage 21 between the purge pump 107 and the intake manifold 2.

Figure 14:
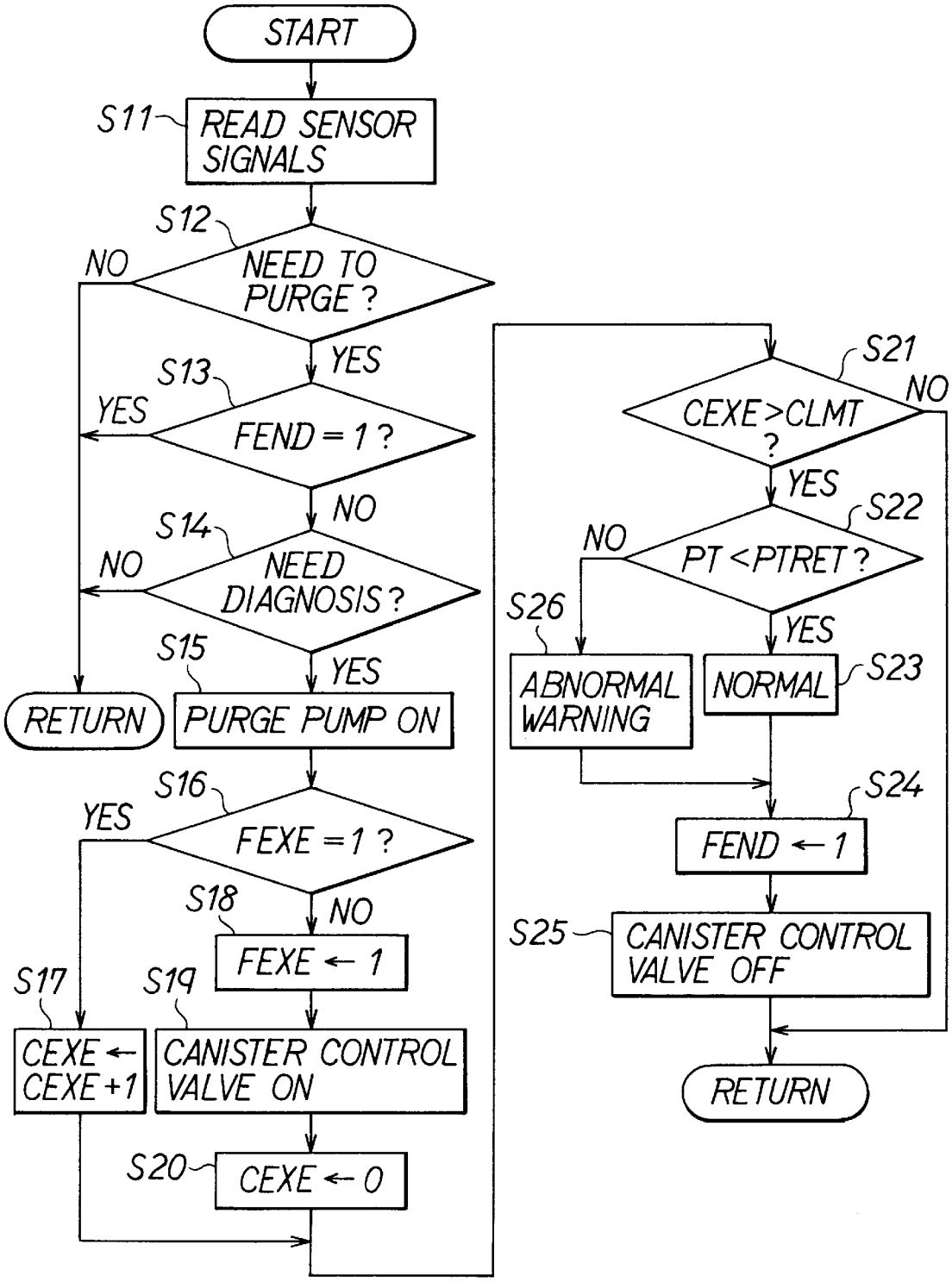
FIG. 14 is a flow chart which represents a failure diagnosis control of a purge ECU according to the fourth embodiment of the present invention.

A failure diagnosis control of the antidissipation apparatus for evaporated fuel vapor 1 by the purge ECU 50 of the fourth embodiment of the present invention is shown in FIG. 14. The failure diagnosis control shown in FIG. 14 is carried out every certain period(for example, every 1 second to 1 minute) for 10 seconds.

At step S11, sensor signals which are required of the failure diagnosis control are read from the E/G ECU 40 and the internal pressure sensor 53, such as sensor signals from the engine rotational speed sensor 41, the speed sensor 42, the throttle sensor 43, cooling water temperature sensor 44, intake amount sensor 45, oxygen sensor 46 and the internal pressure sensor 53.

At step S12, an estimation whether the purge control is necessary is carried out. For example, step 12 determines "YES" and goes to step S13 to carry out the failure diagnosis of the antidissipation apparatus for evaporated fuel vapor 1 when the throttle valve travel and car speed are greater than certain values, when the feedback control of air-fuel ratio is carried out and when the engine rotational speed and the throttle valve travel are not greater than certain values.

At step S13, it is determined that whether a failure diagnosis end flag(FEND) is up(FEND=1). When the failure diagnosis end flag(FEND) is down(FEND≠1), the necessity for carrying out the failure diagnosis is determined at step S14.

At step S14, whether sensor signals read at step S11 satisfy the necessary conditions for carrying out the failure diagnosis such as the engine rotational speed, the driving condition of the car and the cooling water temperature (For example, "Is the engine rotational speed over a certain value?" and "Is the water temperature over 80° C.?") is determined. Step S14 may determine whether certain amount of time (for example, 1 to 12 hours) has passed after the last failure diagnosis. When it is determined that the sensor signals satisfy such necessary conditions, the purge pump 107 is actuated by actuating the motor 100 at step S15.

At step S16, it is determined that whether the antidissipation apparatus for evaporated fuel vapor 1 is in the middle of the failure diagnosis(FEXE=1). When it is determined that it is in the middle of the failure diagnosis(FEXE=1), a counter(CEXE) is incremented by 1(change CEXE to CEXE+1) at step S17 and goes to next step S21.

When it is determined that it is not in the middle of the failure diagnosis(FEXE≠1) at step S16, a failure diagnosis pending flag(FEXE) is set at step S18 and goes to step S19.

At step S19, the atmospheric hole 24 is closed by the canister control valve 6.

At step S20, the counter(CEXE) is reset to 0.

At step S21, it is determined whether the counter(CEXE) is greater than a predetermined value(CLMT) which corresponds to a capacity of the evaporated fuel vapor piping system. For example, it is determined whether the elapsed failure diagnosis time after the actuation of the motor 100 at step S15 and the closing of the canister control valve 6 at step S19 is greater than a predetermined time period such as 5 to 10 seconds. When it is determined that the counter (CEXE) is greater than a predetermined value(CLMT), it goes to step S22.

At step S22, it is determined whether the internal pressure of the fuel tank 11 (PT) which is detected by the internal pressure sensor 53 is lower than the predetermined internal pressure (PTRET) which is, for example, 10 mmHg lower than the atmospheric pressure.

When it is determined that the internal pressure of the fuel tank 11 (PT) is lower than the predetermined internal pressure (PTRET) at step S22, it is determined that the antidissipation apparatus for evaporated fuel vapor 1 is normal at step S23 and a failure diagnosis end flag(FEND) is set up(FEND=1) at step S24.

When it is determined that the internal pressure of the fuel tank 11 (PT) is not lower than the predetermined internal pressure (PTRET) at step S22, it is determined that the antidissipation apparatus for evaporated fuel vapor 1 has a failure and informs a driver of the failure by means of sound warning such as a buzzer and/or sight warning such as a lump at step S26 and a failure diagnosis end flag(FEND) is set up(FEND=1) at step S24.

At step S25, the atmospheric hole 24 is opened by shutting off current to the canister control valve 6.

According to the fourth embodiment of the present invention, an extra fuel piping system to actuate the purge pump as shown in the first through third embodiments is not required because the purge pump 107 is actuated by the motor 100. Therefore, the cost of the antidissipation apparatus for evaporated fuel vapor 1 can be reduced.

According to the failure diagnosis control of the fourth embodiment of the present invention, failures caused by a crack of the fuel tank 11, a crack, a bend or crushing of a rubber hose which forms the purge passage 21, a disconnection of the rubber hose and failures of the purge pump 107 or purge control valve 9 can be detected because the internal pressure of the fuel tank 11 (PT) becomes higher than the predetermined internal pressure (PTRET) when air leak into the evaporated fuel vapor piping system including the purge passage 21 since the internal pressure of the fuel tank 11 (PT) is close to the pressure at the intake manifold which is lower than the atmospheric pressure.

(Fifth Embodiment)

Figure 15:
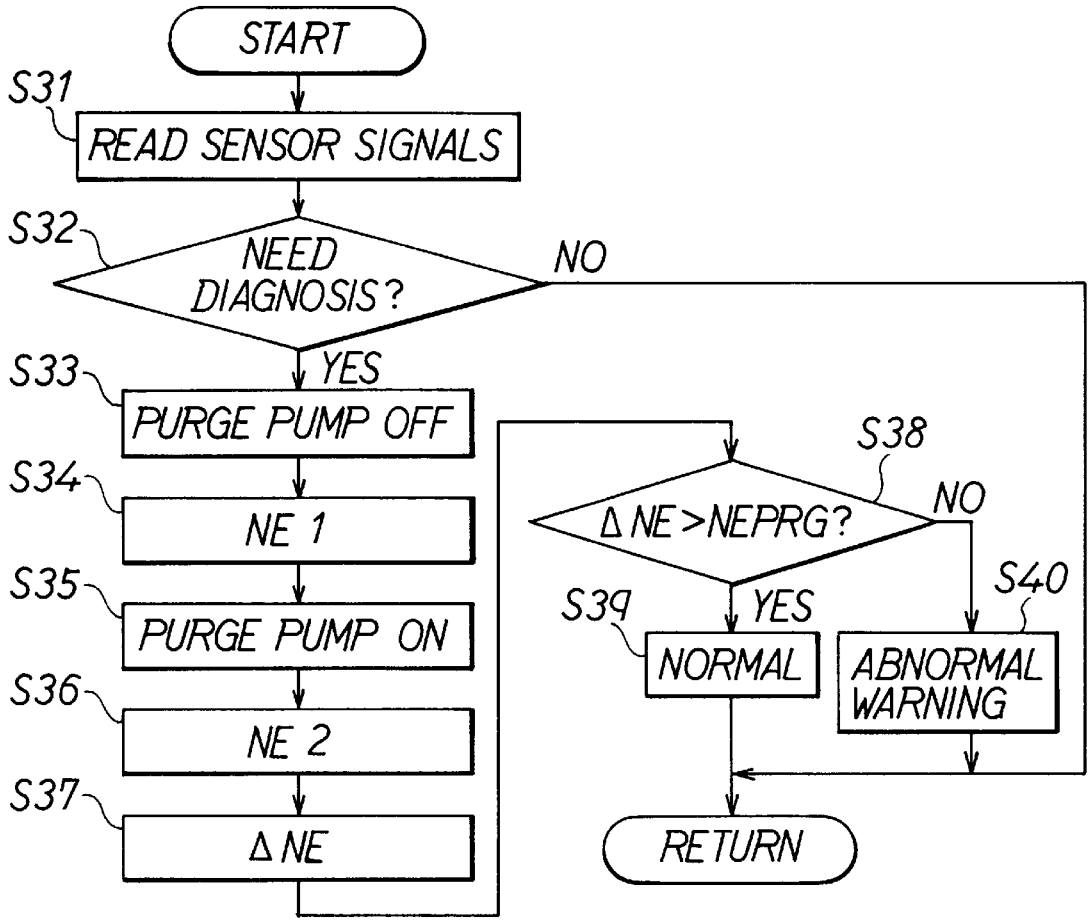
FIG. 15 is a flow chart which represents a failure diagnosis control of a purge ECU according to a fifth embodiment of the present invention.
Figure 16:
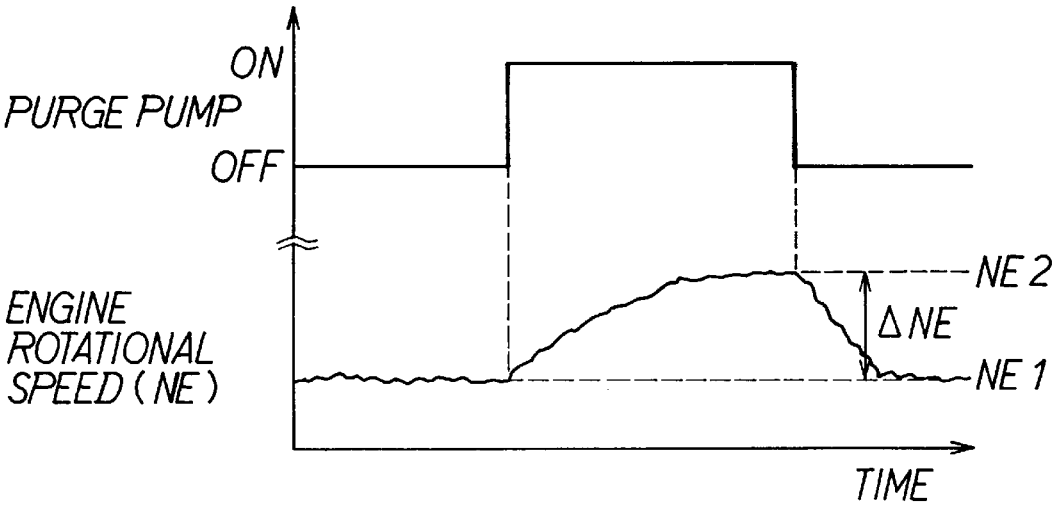
FIG. 16 is a time chart which represents a relationship between a driving condition of a purge pump and a rotational speed of an engine according to the fifth embodiment of the present invention.

A fifth embodiment of the present invention is shown in FIGS. 15 and 16. FIG. 15 is a flow chart which represents a failure diagnosis control of a purge ECU according to the fifth embodiment of the present invention. FIG. 16 is a time chart which represents a relationship between a driving condition of a purge pump and a rotational speed of an engine according to the fifth embodiment of the present invention.

The difference between the fourth embodiment and the fifth embodiment is the failure diagnosis control.

At step S31, sensor signals which are required of the failure diagnosis control are read from the E/G ECU 40, such as sensor signals from the engine rotational speed sensor 41, the speed sensor 42, the throttle sensor 43 and etc.

At step S32, the necessity for carrying out the failure diagnosis is determined. At step S32, whether sensor signals read at step S31 satisfy the necessary conditions for carrying out the failure diagnosis such as the engine rotational speed, the driving condition of the car and the cooling water temperature (For example, "Is the engine rotational speed over a certain value?" and "Is the water temperature over 80° C.?") is determined. Step S32 may determine whether certain amount of time (for example, 1 to 12 hours) has passed after the last failure diagnosis. When it is determined that the sensor signals satisfy such necessary conditions, the purge pump 107 is stopped by shutting off current to the motor 100 at step S33.

At step S34, an engine rotational speed(NE) which is detected by the engine rotational speed sensor 41 is stored as a first engine rotational speed(NE1).

At step S35, the purge pump 107 is actuated by the motor 100.

At step S36, an engine rotational speed(NE) which is detected by the engine rotational speed sensor 41 is stored as a second engine rotational speed(NE2).

At step S37, an engine rotational speed difference(ΔNE) is calculated from the following equation.

$$\Delta NE=(NE2-NE1)$$

At step S38, it is determined whether the engine rotational speed difference(ΔNE) is greater than a predetermined engine rotational speed difference(NEPRG). For example, the predetermined engine rotational speed difference (NEPRG) is 50 rpm. When it is determined that the engine rotational speed difference(ΔNE) is greater than a predetermined engine rotational speed difference(NEPRG), it is determined that the antidissipation apparatus for evaporated fuel vapor 1 is normal at step S39.

When it is determined that the engine rotational speed difference(ΔNE) is not greater than a predetermined engine rotational speed difference(NEPRG), it is determined that the antidissipation apparatus for evaporated fuel vapor 1 has a failure and informs a driver of the failure by means of sound warning such as a buzzer and/or sight warning such as a lump at step S40.

Generally speaking, when evaporated fuel vapor which is adsorbed at the canister 22 is purged into the intake manifold 2, the amount of intake air at the intake manifold 2 increases because the purge pump 107 sucks air through the atmospheric hole 24. Therefore, the second engine rotational speed(NE2) when the purge pump 107 is in operation becomes greater than the first engine rotational speed(NE1) when the purge pump 107 is not in operation by ΔNE as shown in FIG. 16.

According to the failure diagnosis control of the fifth embodiment of the present invention, failures of the purge pump 107 can be estimated when the engine rotational speed difference(ΔNE) is not greater than a predetermined engine rotational speed difference(NEPRG) because it is considered that the purge pump 107 is not in operation.

Although the purge pumps which are actuated by the flow of fuel are described in the first through third embodiments of the present invention, the purge pump may be actuated by the engine instead of the flow of fuel.

Although the purge pumps which are actuated by the flow of fuel in the sub-fuel passage 35 are described in the first and third embodiments of the present invention, the purge pump may be actuated by the flow of fuel in the main fuel passage 15.

Although the purge control valve 9 is provided at the downstream or the upstream of the purge pump 107 in the fourth and the fifth embodiments of the present invention, the purge control valve 9 may be eliminated.

Although the purge pump 107 is actuated by the motor 100 in the fourth and the fifth embodiments of the present invention, various types of motor may be used.

Although the side channel pump is used as the purge pumps 7 and 107 in the first through third embodiments of the present invention, a vane pump, an internal gear pump, an outer gear pump, a compressor, a fan or a blower may be used as a substitute for the side channel pump.

Although the bypass valve 8 is located on the bypass passage 37 in the first through third embodiments of the present invention, a flow control valve which controls fuel flow in the sub-fuel passage 35 may be used as a substitute for the bypass valve 8 and the bypass passage 37.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. An antidissipation apparatus for evaporated fuel vapor for an internal combustion engine having an intake manifold, a fuel passage and a fuel tank comprising:

a purge passage which connects said intake manifold and said fuel tank;

a canister installed in said purge passage that adsorbs evaporated fuel vapor generated in said fuel tank; and a purge pump installed in said purge passage that delivers said adsorbed evaporated fuel vapor to said intake manifold, said purge pump being driven by at least a part of a fuel flow in said fuel passage so that said purge pump changes its discharge amount of said adsorbed evaporated fuel vapor to said intake manifold according to an amount of said fuel flow in said fuel passage.

2. An antidissipation apparatus for evaporated fuel vapor according to claim 1, wherein:

said purge pump further includes a rotation shaft that is rotated according to said amount of said fuel flow in said fuel passage; and said purge pump changes its discharge amount of said adsorbed evaporated fuel vapor to said intake manifold according to rotation of said rotation shaft.

3. An antidissipation apparatus for evaporated fuel vapor according to claim 1, further comprising:

a bypass passage that diverts said fuel flow from said fuel pump according to predetermined conditions, and a bypass valve installed in said bypass passage for changing said diverted fuel flow in said bypass passage according to said predetermined conditions.

4. An antidissipation apparatus for evaporated fuel vapor according to claim 1, wherein:

said canister further includes an atmospheric passage that vents an upstream side of said canister, and a canister control valve which opens or closes said atmospheric passage; and said purge pump is installed between said canister and said canister control valve.

5. An antidissipation apparatus for evaporated fuel vapor according to claim 4, further comprising:

an internal pressure detector which detects an internal pressure of said purge passage; and failure diagnosis means for determining a failure of said purge pump under condition that said internal pressure of said purge passage detected by said internal pressure detector is higher than a predetermined pressure when said purge pump is in operation and said canister control valve is closed.

6. An antidissipation apparatus for evaporated fuel vapor according to claim 1, further comprising:

an engine rotational speed detector which detects rotational speed of said engine; and failure diagnosis means for determining a failure of said purge pump under condition that a rotational speed difference between a first rotational speed and a second rotational speed is smaller than a predetermined rotational speed difference, said first rotational speed being detected by said engine rotational speed detector when said purge pump is not in operation, said second rotational speed being detected by said engine rotational speed detector when said purge pump is in operation.

7. An antidissipation apparatus for evaporated fuel vapor according to claim 1, further comprising:

a purge control valve which controls a flow rate of evaporated fuel vapor to be delivered to said intake manifold via said purge passage according to a duty ratio of said purge control valve;

required purge flow determining means for determining a required purge flow of evaporated fuel vapor to be supplied to said intake manifold according to a driving condition of said engine;

purge flow decreasing means for decreasing said discharge amount when said required purge flow is smaller than a predetermined purge flow;

duty ratio determining means for determining said duty ratio of said purge control valve according to said required purge flow under condition that said flow rate of evaporated fuel vapor is restricted by said discharge amount which is decreased by said purge flow decreasing means; and purge flow control means for controlling said purge control valve according to said duty ratio determined by said duty ratio determining means.

8. An antidissipation apparatus for evaporated fuel vapor for an internal combustion engine having an intake manifold and a fuel tank comprising:

a purge passage for connecting said intake manifold and said fuel tank;

a canister installed in said purge passage for absorbing evaporated fuel vapor which is generated in said fuel tank;

a motor; and a purge pump installed in said purge passage for delivering said adsorbed evaporated fuel vapor to said intake manifold, said purge pump being controlled by said motor to change its discharge amount of said adsorbed evaporated fuel vapor to said intake manifold based on operating parameters of said engine;

wherein said canister further includes an atmospheric passage which vents an upstream side of said canister and a canister control valve which opens or closes said atmospheric passage; and said purge pump is installed between said canister and said canister control valve.

9. An antidissipation apparatus for evaporated fuel vapor for an internal combustion engine having an intake manifold and a fuel tank comprising:

a purge passage for connecting said intake manifold and said fuel tank;

a canister installed in said purge passage for absorbing evaporated fuel vapor which is generated in said fuel tank;

a motor; and a purge pump installed in said purge passage for delivering said adsorbed evaporated fuel vapor to said intake manifold, said purge pump being controlled by said motor to change its discharge amount of said adsorbed evaporated fuel vapor to said intake manifold based on operating parameters of said engine;

a canister valve located upstream of said canister to open or close an atmospheric passage;

an internal pressure detector which detects an internal pressure of said purge passage; and failure diagnosis means for determining a failure of said purge pump under condition that said internal pressure of said purge passage which is detected by said internal pressure detector is higher than a predetermined pressure when said purge pump is in operation and said canister control valve is closed.

10. An antidissipation apparatus for evaporated fuel vapor for an internal combustion engine having an intake manifold and a fuel tank comprising:

a purge passage for connecting said intake manifold and said fuel tank;

a canister installed in said purge passage for absorbing evaporated fuel vapor which is generated in said fuel tank;

a motor; and a purge pump installed in said purge passage for delivering said adsorbed evaporated fuel vapor to said intake manifold, said purge pump being controlled by said motor to change its discharge amount of said adsorbed evaporated fuel vapor to said intake manifold based on operating parameters of said engine;

an engine rotational speed detector which detects rotational speed of said engine;

failure diagnosis means for determining a failure of said purge pump under condition that a rotational speed difference between a first rotational speed and a second rotational speed is smaller than a predetermined rotational speed difference, said first rotational speed being detected by said engine rotational speed detector when said purge pump is not in operation, said second rotational speed being detected by said engine rotational speed detector when said purge pump is in operation.

11. An antidissipation apparatus for evaporated fuel vapor for an internal combustion engine having an intake manifold, a fuel passage and a fuel tank comprising:

a purge passage for connecting said intake manifold and said fuel tank;

a canister installed in said purge passage for adsorbing evaporated fuel vapor generated in said fuel tank;

a purge pump installed in said purge passage for delivering said adsorbed evaporated fuel vapor to said intake manifold; and failure diagnosis means for determining a failure of said purge pump.

12. An antidissipation apparatus for evaporated fuel vapor according to claim 11, further comprising an internal pressure detector which detects an internal pressure of said purge passage; wherein:

said canister further includes an atmospheric passage which vents an upstream side of said canister, and a canister control valve which opens or closes said atmospheric passage; and said failure diagnosis means determines a failure of said purge pump under condition that said internal pressure of said purge passage which is detected by said internal pressure detector is higher than a predetermined pressure when said purge pump is in operation and said canister control valve is closed.

13. An antidissipation apparatus for evaporated fuel vapor according to claim 11, further comprising an engine rotational speed detector which detects rotational speed of said engine; wherein:

said failure diagnosis means determines a failure of said purge pump under condition that a rotational speed difference between a first rotational speed which is detected by said engine rotational speed detector when said purge pump is not in operation, and a second rotational speed which is detected by said engine rotational speed detector when said purge pump is in operation is smaller than a predetermined rotational speed difference.

14. An antidissipation method for evaporated fuel vapor for an internal combustion engine having an intake manifold, a fuel passage, a fuel tank, a purge passage which connects said intake manifold and said fuel tank and a canister installed in said purge passage that adsorbs evaporated fuel vapor generated in said fuel tank, said method comprising:

pumping adsorbed evaporated fuel vapor from said purge passage to said intake manifold with a pump driven by at least a part of a fuel flow in said fuel passage so that a discharge amount of said adsorbed evaporated fuel vapor to said intake manifold changes according to fuel flow in said fuel passage.

15. A method as in claim 14 further comprising:

diverting said fuel flow from said fuel-driven pump and changing said diverted fuel flow according to predetermined conditions.

16. A method as in claim 14 wherein an atmospheric passage that vents an upstream side of said canister is opened or closed and said pumping step draws evaporated fuel from between said canister and the location of said venting of the atmospheric passage.

17. A method as in claim 16 further comprising:

detecting an internal pressure of said purge passage; and determining a failure of said pumping step under a condition that said internal pressure of said purge passage is higher than a predetermined pressure when said pumping step is in operation and said venting is closed.

18. A method as in claim 14 further comprising:

detecting rotational speed of said engine; and determining a failure of said pumping step under a condition that a rotational speed difference between a first rotational speed and a second rotational speed is smaller than a predetermined rotational speed difference, said first rotational speed being detected by said engine rotational speed detecting step when said pumping step is not in operation, said second rotational speed being detected by said engine rotational speed detecting step when said pumping step is in operation.

19. A method as in claim 14 further comprising:

controlling a flow rate of evaporated fuel vapor to be delivered to said intake manifold via said purge passage according to a duty ratio;

determining a required purge flow of evaporated fuel vapor to be supplied to said intake manifold according to a driving condition of said engine;

decreasing said discharge amount when said required purge flow is smaller than a predetermined purge flow; and determining said duty ratio according to said required purge flow under condition that said flow rate of evaporated fuel vapor is restricted by said discharge amount which is decreased by said purge flow decreasing step.

20. An antidissipation method for evaporated fuel vapor for an internal combustion engine having an intake manifold, a fuel tank, a purge passage for connecting said intake manifold and said fuel tank, a canister installed in said purge passage for adsorbing evaporated fuel vapor which is generated in said fuel tank, and a motor driven purge pump installed in said purge passage for delivering a controlled discharge amount of said adsorbed evaporated fuel vapor to said intake manifold based on operating parameters of said engine, said method comprising:

venting an open or closed atmospheric passage upstream of said canister, detecting an internal pressure of said purge passage; and determining a failure of said purge pump under condition that said internal pressure of said purge passage is higher than a predetermined pressure when said purge pump is in operation and said venting is closed.

21. An antidissipation method for evaporated fuel vapor for an internal combustion engine having an intake manifold, a fuel tank, a purge passage for connecting said intake manifold and said fuel tank, a canister installed in said purge passage for adsorbing evaporated fuel vapor which is generated in said fuel tank, and a motor driven purge pump installed in said purge passage for delivering a controlled discharge amount of said adsorbed evaporated fuel vapor to said intake manifold based on operating parameters of said engine, said method comprising:

detecting rotational speed of said engine;

determining a failure of said purge pump under condition that a rotational speed difference between a first rotational speed and a second rotational speed is smaller than a predetermined rotational speed difference, said first rotational speed being detected when said purge pump is not in operation, said second rotational speed being detected when said purge pump is in operation.

22. An antidissipation method for evaporated fuel vapor for an internal combustion engine having an intake manifold, a fuel passage, a fuel tank, a purge passage connecting said intake manifold and said fuel tank, a canister installed in said purge passage for adsorbing evaporated fuel vapor generated in said fuel tank, and a purge pump installed in said purge passage for delivering said adsorbed evaporated fuel vapor to said intake manifold, said method comprising:

determining a failure of said purge pump;

detecting an internal pressure of said purge passage;

venting an atmospheric passage on an upstream side of said canister to open or close said atmospheric passage; and determining a failure of said purge pump under condition that said internal pressure of said purge passage is higher than a predetermined pressure when said purge pump is in operation and said venting is closed.

23. An antidissipation method for evaporated fuel vapor for an internal combustion engine having an intake manifold, a fuel passage, a fuel tank, a purge passage connecting said intake manifold and said fuel tank, a canister installed in said purge passage for adsorbing evaporated fuel vapor generated in said fuel tank, and a purge pump installed in said purge passage for delivering said adsorbed evaporated fuel vapor to said intake manifold, said method comprising:

determining a failure of said purge pump;

detecting rotational speed of said engine; and determining a failure of said purge pump under condition that a rotational speed difference between a first rotational speed when said purge pump is not in operation, and a second rotational speed when said purge pump is in operation is smaller than a predetermined rotational speed difference.

* * * * *